US005984091A

United States Patent [19]

Orr et al.

[11] Patent Number: 5,984,091

[45] Date of Patent: Nov. 16, 1999

[54] UNITARY PACKAGE CONTAINING SOUVENIR POSTCARD AND MATCHING UTILITARIAN ITEM

[75] Inventors: Peter W. Orr, Van Nuys; Daniel Zipser, Westlake Village, both of Calif.

[73] Assignee: Spartacus Management Company, Chatsworth, Calif.

[21] Appl. No.: 09/020,745

[22] Filed: Feb. 9, 1998

Related U.S. Application Data

[63] Continuation-in-part of application No. 08/851,883, May 6, 1997.

[51] Int. Cl.[6] ..... B65D 69/00

[52] U.S. Cl. ..... 206/232; 206/461; 206/471

[58] Field of Search ..... 206/232, 449, 206/461, 470, 471

[56] References Cited

U.S. PATENT DOCUMENTS

| | | | |
|---|---|---|---|
| 2,067,119 | 1/1937 | Ellner | 206/232 |
| 3,420,361 | 1/1969 | Newberg | 206/470 |
| 3,464,135 | 9/1969 | Eidinger | 206/232 |
| 3,500,995 | 3/1970 | Forman | 206/449 |
| 3,958,690 | 5/1976 | Gee, Sr. | 206/232 |
| 4,619,364 | 10/1986 | Czopor, Jr. | 206/470 |
| 4,749,082 | 6/1988 | Gardiner et al. | 206/471 |
| 4,807,747 | 2/1989 | Hadtke | 206/470 |
| 4,848,014 | 7/1989 | Yesbick . | |
| 4,918,299 | 4/1990 | Ohmori . | |
| 4,979,619 | 12/1990 | Hager . | |
| 5,000,327 | 3/1991 | Kincheloe | 206/232 |
| 5,113,612 | 5/1992 | Machen | 40/336 |
| 5,186,499 | 2/1993 | Mason | 206/461 |
| 5,205,059 | 4/1993 | Doll . | |
| 5,275,438 | 1/1994 | Struhl | 206/232 |
| 5,415,290 | 5/1995 | Merkley et al. | 206/434 |

*Primary Examiner*—David T. Fidei
*Attorney, Agent, or Firm*—Jeffer, Mangels, Butler & Marmaro LLP

[57] ABSTRACT

A package is disclosed containing a picture postcard and a utilitarian item, both the postcard and the telephone card bearing the same illustration. The package is of transparent plastic for simultaneous viewing of both the postcard and the utilitarian item. The postcard can be removed and mailed the same as any souvenir card and the utilitarian item can be separately employed and/or displayed.

14 Claims, 6 Drawing Sheets

UNITARY PACKAGE CONTAINING SOUVENIR POSTCARD AND MATCHING UTILITARIAN ITEM

This is a continuation-in-part of U.S. patent application Ser. No. 08/851,883, filed May 6, 1997, the disclosure of which is incorporated herein by reference.

FIELD OF THE INVENTION

The present invention relates to packaging for consumer products.

BACKGROUND OF THE INVENTION

Postal cards which bear a scene or the like on one side and a place for a message and an address to which the card can be sent are well known. In recent years, prepaid telephone cards have become quite popular. These phone cards are usually sold separately in retail stores. These cards can be used in certain public telephones to make prepaid long distance calls. Such stores also carry postcards bearing images associated with the geographical location in which such postcards are sold.

Since there is much competition for the sale of phone cards, there is a need to make phone cards more saleable to the buying public. There is quite a bit of competition for display space in retail stores where such cards are sold. Also, such prepaid phone cards are usually an impulse buy item and displayed in stores near the checkout counters. There is a need for catching the attention of a shopper so that the shopper will buy such prepaid phone cards.

A need exists for a package containing both a souvenir postcard and a matching prepaid telephone card.

A need also exists for a package which is transparent with both the postcard and the prepaid telephone card visible to the public when such package is displayed in a store or the like.

There is also a need for a package which allows the public to collect such postcards, mail them or keep them, and use the telephone card to place long distance calls, then save such phone cards as a collectible souvenir.

There is also a need for a package that contains other items besides a prepaid telephone card that also bears the same indicia as the postcard.

SUMMARY OF THE PREFERRED EMBODIMENTS

In accordance with one aspect of the present invention, there is provided a package having first and second compartments. A removable picture postcard is disposed within the first compartment, and at least one removable utilitarian item other than a postal card is disposed within the second compartment. Both the postcard and the utilitarian item bear similar indicia, such as a pictorial presentation. The package preferably is of transparent plastic for simultaneous viewing of both the postcard and the utilitarian item. The postcard can be removed and mailed the same as any souvenir card and the utilitarian item can be placed in a wallet or purse, worn, or otherwise displayed or stored, and when the item is a prepaid telephone card, can be saved after use as a collectible. The postcard thus can be either mailed to another or saved as a souvenir.

In a preferred embodiment, two or more utilitarian items can be disposed in the second compartment.

In accordance with another aspect of the present invention, there is provided a package having a first compartment and a plurality of second compartments. A removable postal card is disposed within the first compartment and has indicia on at least one side thereof. A plurality of removable utilitarian items are respectively disposed within one of the plurality of second compartments. At least one of the utilitarian items has indicia on at least one side thereof.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
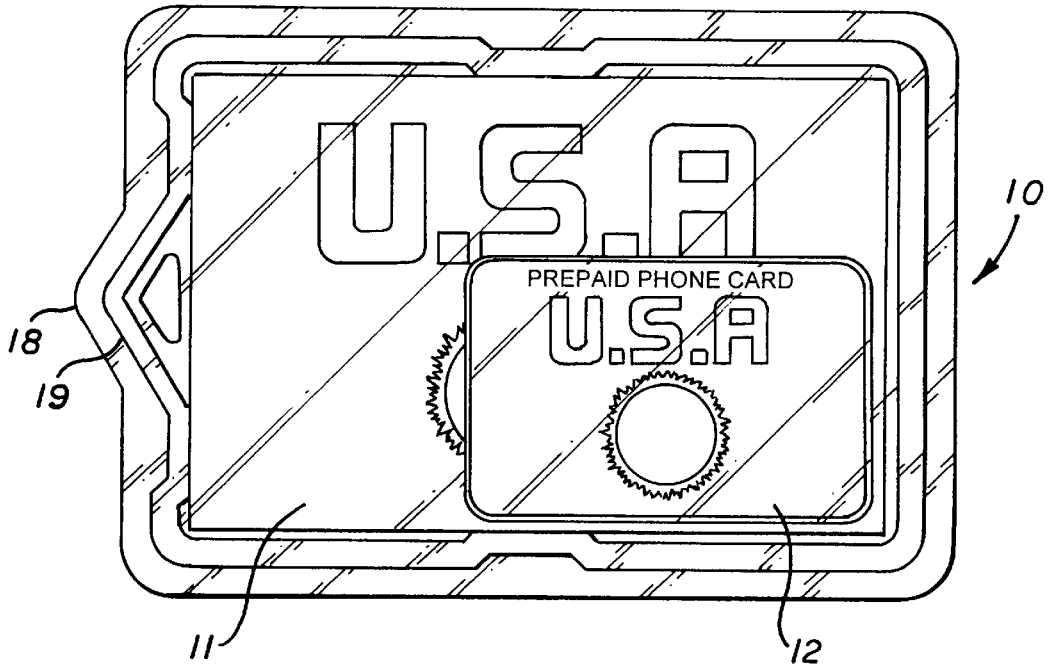
FIG. 1 is a front elevational view of a package containing a souvenir postcard and matching utilitarian item which is a phone card in accordance with the teachings of the invention.
Figure 2:
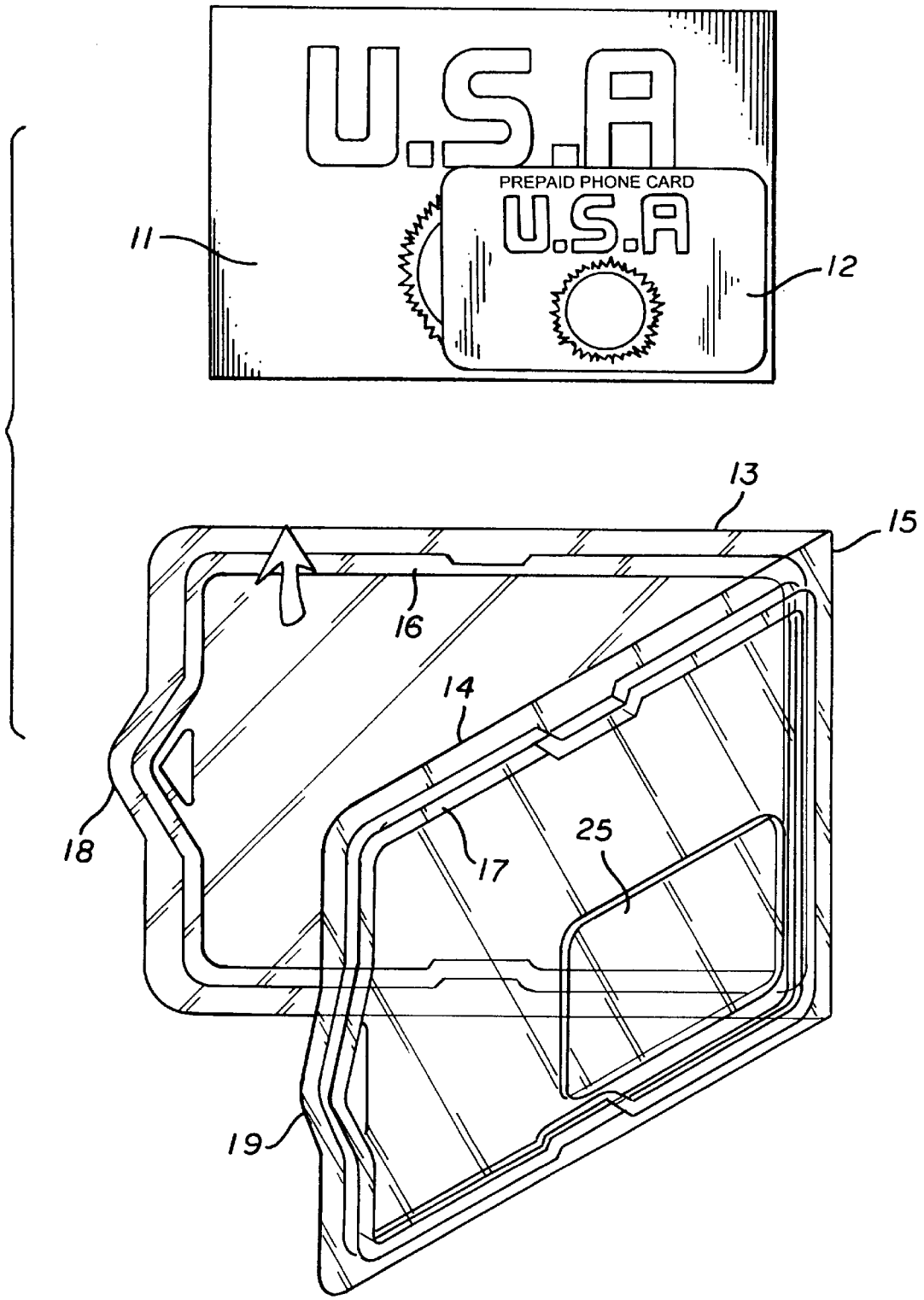
FIG. 2 is an exploded view of the package of FIG. 1, the cards being removed from the package.

Referring now to FIG. 1 of the drawing, a single package 10 is shown having a postal card 11 and a utilitarian item, here a prepaid telephone card 12, disposed therein. Any suitable package can be used. However, both postal card 11 and telephone card 12 are preferably visible so that the package presents an enticing appearance to the potential buyer. Thus, as seen in FIG. 2, package 10 may be comprised of a pair of panels 13, 14 hinged at integral hinge 15 having inner peripheral ridges 16 on one panel, such as panel 13, and inner peripheral grooves 17 on the other panel, such as panel 14, adapted to mate and interlock to close package 10. The panels 13, 14 can be quickly and easily separated by peeling them apart along edges 18, 19, respectively, (see also FIG. 1) as is well known in the art. Thus, package 10 may be made of a transparent plastic material, preferably heat sealed about the edges for security and easily peeled apart to provide access to postal card 11 and phone card 12. Thus, as seen in FIGS. 1 and 2, postal card 1 1 fits into a first compartment defined by the inner area of panel 13 bordered by ridge 16. Any suitable dimensions may be used but preferably postal card 11 is 4" by 6" as are conventional souvenir picture postcards.

Card 12 is smaller so that it can be carried in one's wallet or a purse or the like and is generally about 3 ⅜" by 2 ⅛". Card 12 is retained in a second compartment, for example rectangular compartment 25 (FIG. 2) stamped or otherwise formed in panel 14 (extending outwardly away from panel 13).

Figure 3:
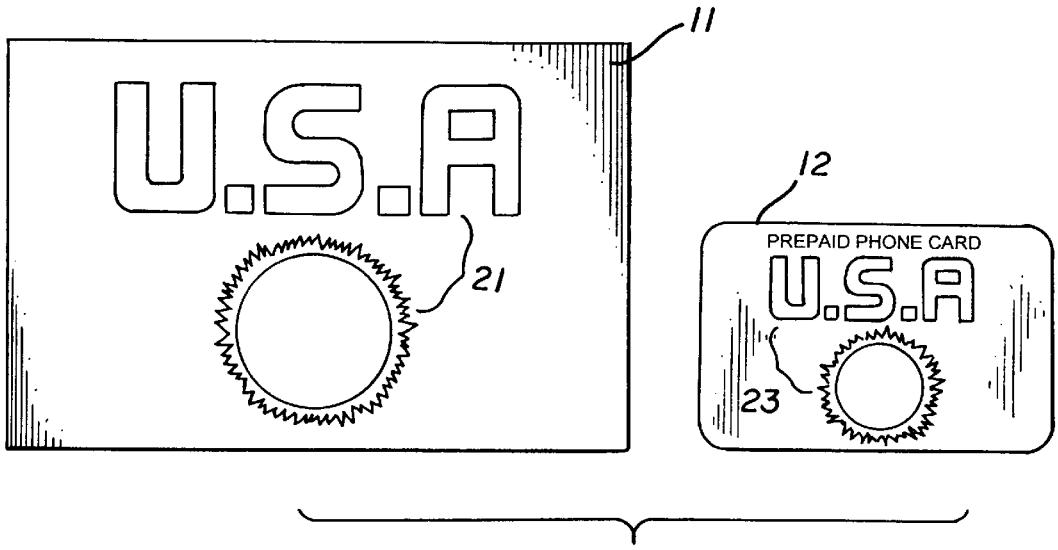
FIG. 3 is a front elevational view of the postcard and phone card of FIGS. 1 and 2 removed from the package of FIG. 1.

As seen in FIG. 3, card 11 has indicia 21 thereon which may be a scene or image having geographical or historical significance for the area in which package 10 are to be sold. Thus, for example, card 11 in FIG. 3 has a simulated stylized sun and the letters U.S.A. Card 11 may have indicia on the back thereof for writing a message, addressing the card to an addressee, etc.

Card 12, FIG. 1, has indicia 22 in the form of a scene preferably similar to that appearing on card 11, e.g., the sun and U.S.A. However, the words "Prepaid Phone Card" preferably appear on card 12. Other indicia, such as the company issuing the phone card, the price of the card, etc., may additionally appear on the card. Telephone instructions may appear on the back of the card. The actual location of any indicia, on the front or back, of either cards 11, 12 is arbitrary; however, the scenes displayed on both cards, such as the sun and U.S.A., are the same. The colors used may be those normally associated with the scene depicted, e.g., orange for the sun, etc.

The indicia may be any scenic depiction, such as a photograph, artwork, painting, etc.

Obviously, package 10 is directed to the tourist industry who will see such packages in stores or the like located at tourist spots throughout the world. The buyer will see a scene having some significance to the area, buy the package, mail or save the postcard, then pocket the phone card to make long distance calls. After the calls are made, the user can save the phone card as another souvenir or collectible. The phone cards may of course be of any suitable duration, good for both domestic and international calls, priced accordingly. The postcard is used separately as a souvenir.

If desired, multiple postal cards can be disposed within the inventive package. For example, two postal cards can be disposed back to back within the first compartment.

Figure 4:
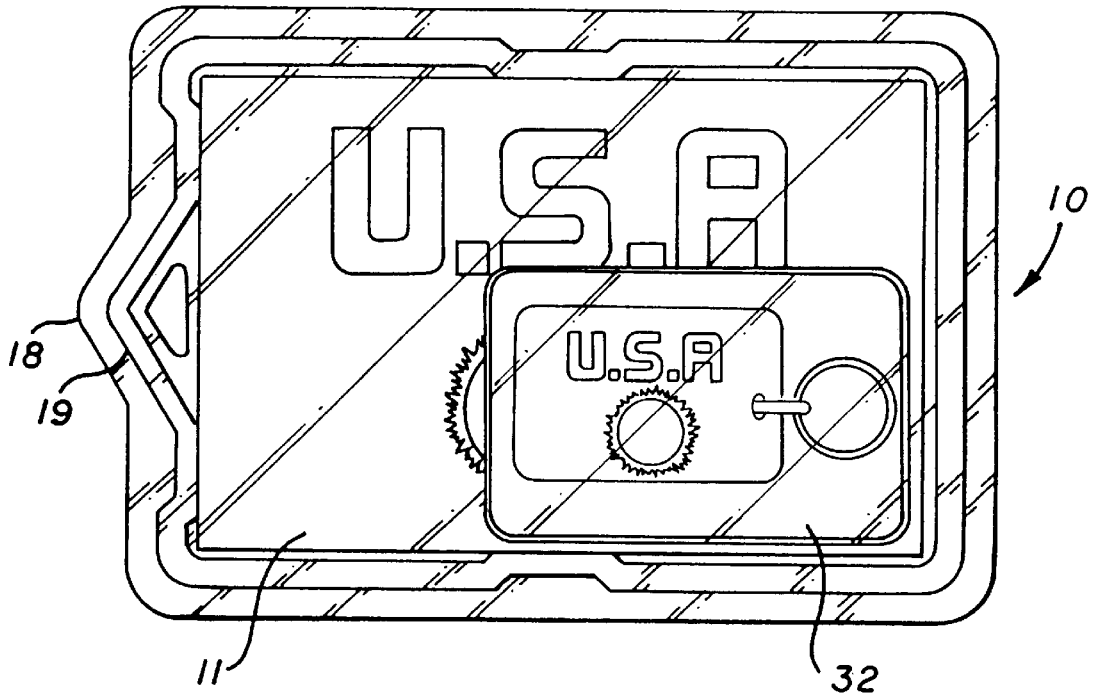
FIG. 4 is a front elevational view of a package containing a souvenir postcard and matching utilitarian item which is a keychain in accordance with another aspect of the invention.

As shown in FIGS. 4, and 6–10, in place of, or in addition to, prepaid telephone cards, the present invention can also include other utilitarian items. Such items include, without limitation, keychains, magnets, in particular flexible magnets such as refrigerator magnets, articles of clothing 34 such as scarves or headbands, articles of jewelry 35 such as lapel buttons, writing instruments 36 such as pens or markers, cigarette lighters 37 glasses 38 such as shot glasses, and the like. FIG. 4 illustrates an alternative package of the invention which includes a keychain 32 as the utilitarian item.

Figure 5:
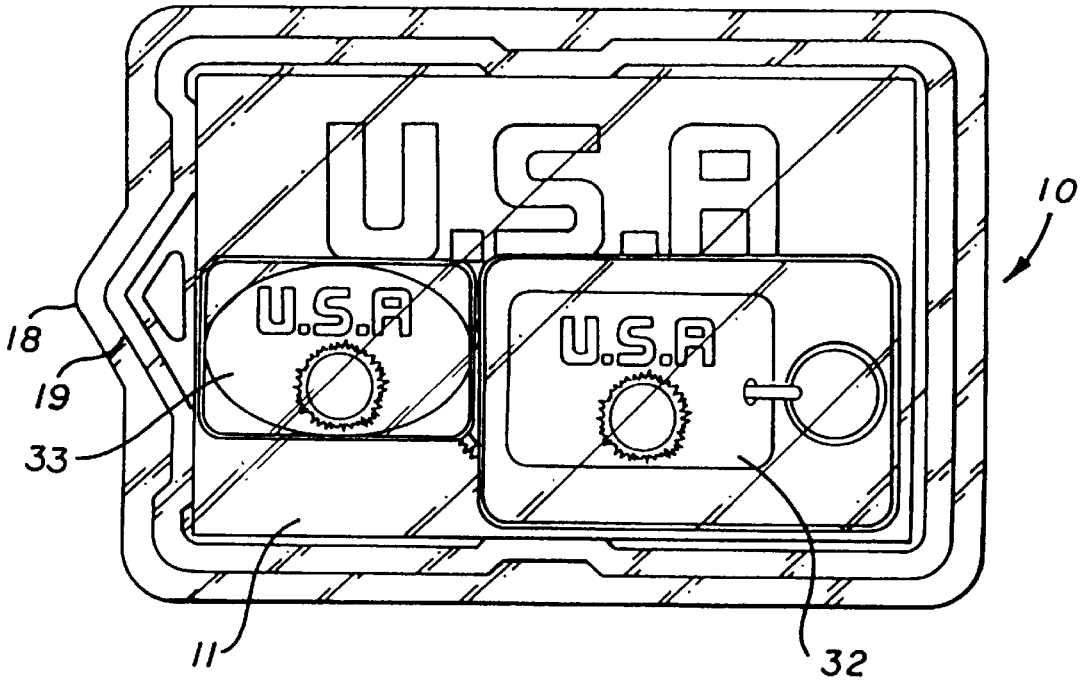
FIG. 5 is a front elevational view of a package containing a souvenir postcard and a plurality of utilitarian items, including a keychain and a refrigerator magnet, each of which has matching indicia.
Figure 6:
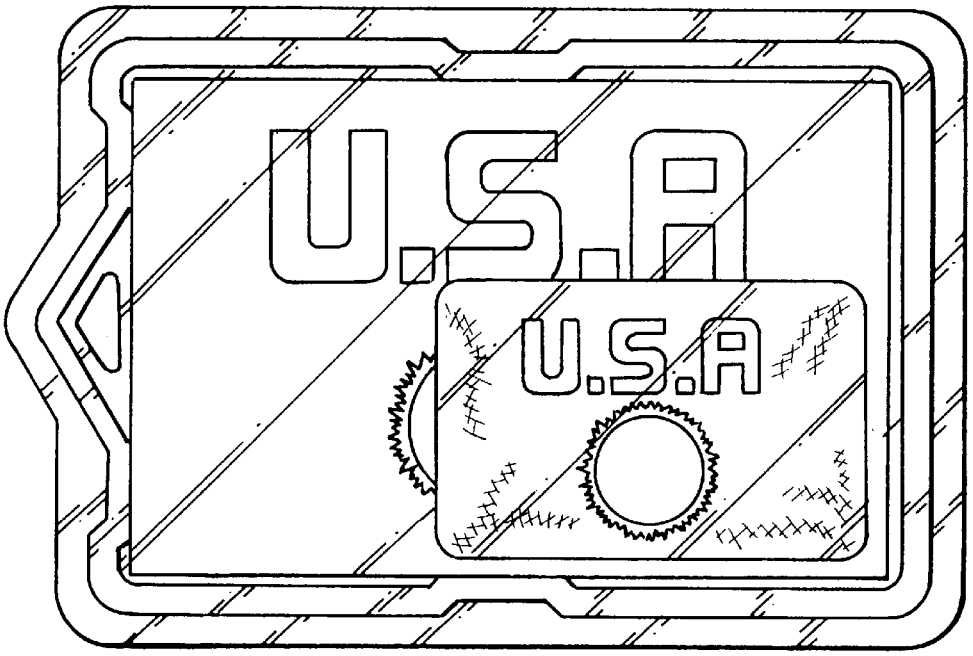
FIG. 6 is a front elevational view of a package containing a souvenir postcard and matching utilitarian item which is an article of clothing in accordance with the teachings of the invention.
Figure 7:
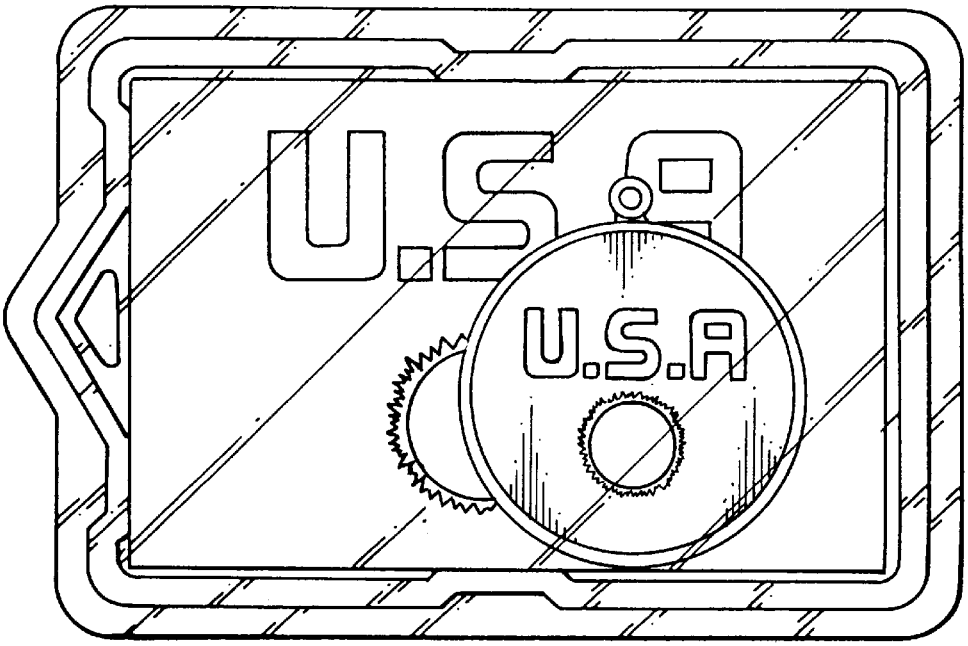
FIG. 7 is a front elevational view of a package containing a souvenir postcard and matching utilitarian item which is an article of jewelry in accordance with the teachings of the invention.
Figure 8:
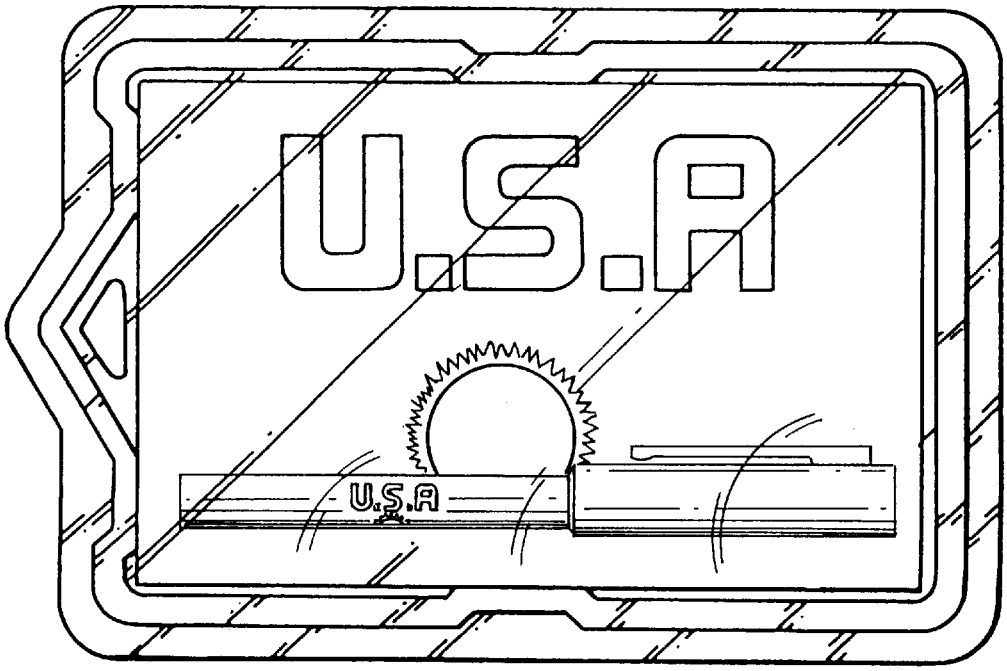
FIG. 8 is a front elevational view of a package containing a souvenir postcard and matching utilitarian item which is a writing instrument in accordance with the teachings of the invention.
Figure 9:
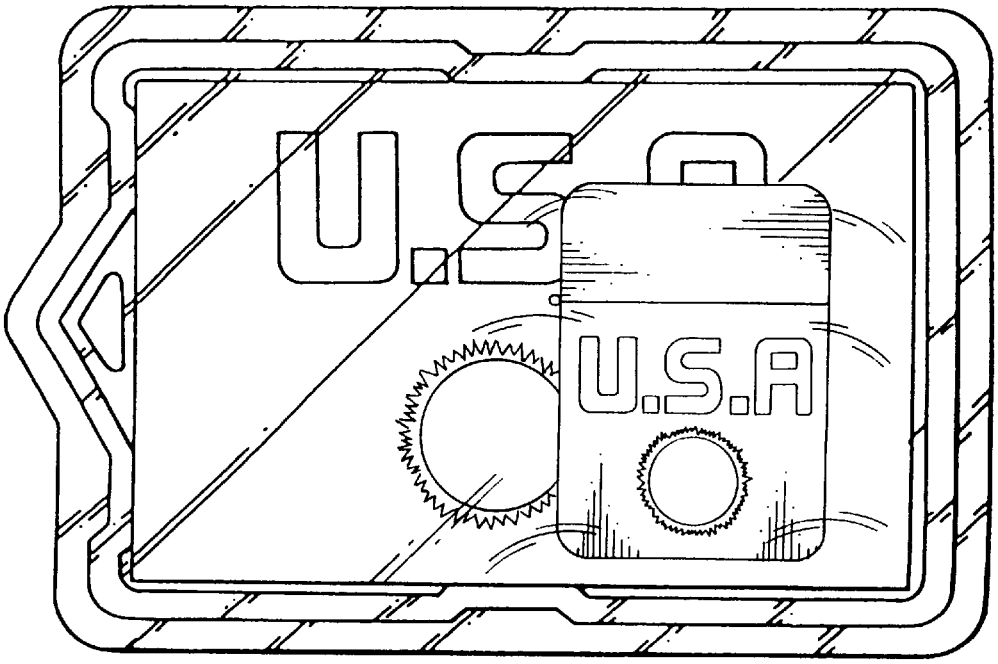
FIG. 9 is a front elevational view of a package containing a souvenir postcard and matching utilitarian item which is a cigarette lighter in accordance with the teachings of the invention.
Figure 10:
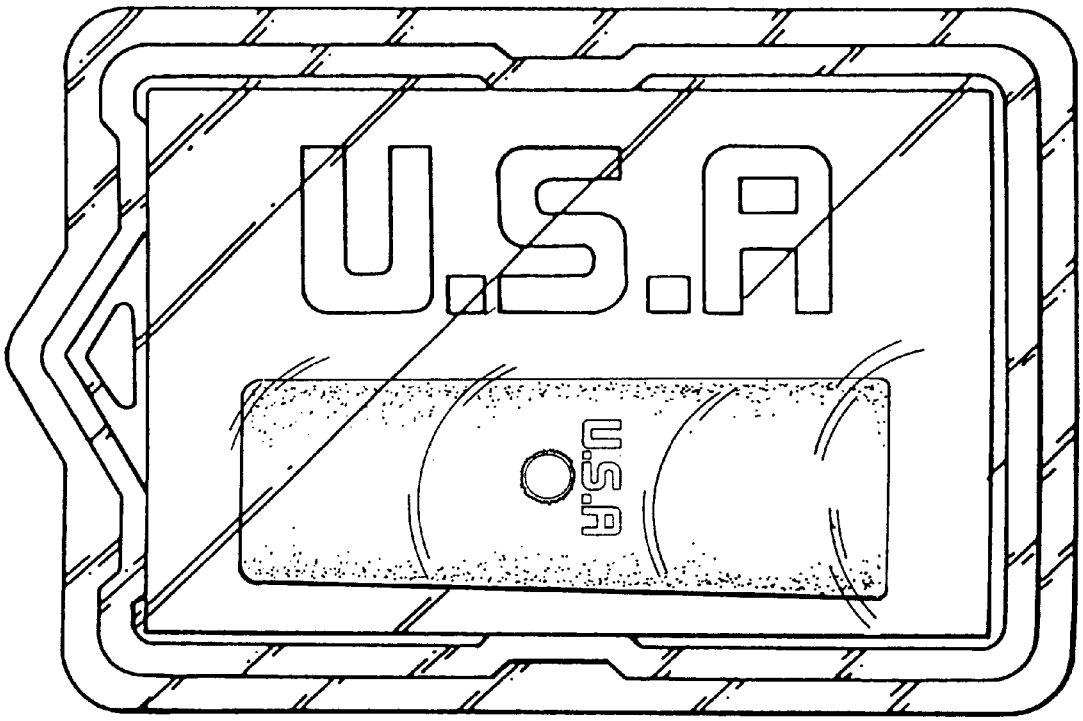
FIG. 10 is a front elevational view of a package containing a souvenir postcard and matching utilitarian item which is a glass in accordance with the teachings of the invention.

Multiple utilitarian items can also be included in a package according to the invention. Thus, two or more items can be included in the same compartment. In an alternative embodiment shown in FIG. 5, a postal card is disposed in a first compartment, while a keychain 32 and a refrigerator magnet 33 are disposed in respective second compartments. In another alternative embodiment, a first utilitarian item can be disposed within the first compartment and secured to the compartment or to the postal card, while one or more additional utilitarian items can be disposed within a second compartment or compartments.

When multiple second compartments are employed, they can be formed on the same side of the package or on opposite sides of the package.

Although a particular embodiment of the invention is disclosed, variations thereof may occur to an artisan and the scope of the invention is only limited by the scope of the appended claims.

What is claimed is:

1. A consumer package to be purchased by a consumer as a single unit, said package comprising (a) first and second compartments;

(b) a removable postcard disposed within said first compartment, said postcard having a pictorial presentation on at least one side thereof; and (c) at least one removable utilitarian item removably disposed within said second compartment, said at least one utilitarian item having a pictorial presentation on at least one side thereof matching the pictorial presentation on said postcard.

2. The package of claim 1 wherein said package is of a transparent material, the pictorial presentation on said at least one side of said postcard being at least partially visible from the exterior of said package and the pictorial presentation on said at least one side of said utilitarian item being visible from the exterior of said package.

3. The package of claim 2 wherein said first compartment is a first panel of said package having a first closure portion extending about the inner periphery thereof surrounding said postcard and said second compartment is provided in a second panel hingedly secured to said first panel having a second closure portion adapted to mate with said first closure portion extending about the inner periphery thereof, said second compartment being a cavity formed in the second panel extending outwardly away from the interior of said package.

4. The package of claim 3 wherein said second compartment is oriented in the lower right corner of said package when said panels are in mating relationship and said pictorial presentation on both said postcard and said utilitarian item are visible to the exterior of said package.

5. The package of claim 1 comprising a plurality of said utilitarian items.

6. The package of claim 1 wherein said utilitarian item is selected from the group consisting of a keychain, a magnet, an article of clothing, an article of jewelry, a writing instrument, a phone card, a cigarette lighter and a glass.

7. A consumer package to be purchased by a consumer as a single unit, said package containing therein both a removable postcard having a pictorial presentation on at least one side thereof and a removable utilitarian item having a pictorial presentation on at least one side thereof, wherein said pictorial presentation on said postcard matches said pictorial presentation on said utilitarian item.

8. The package of claim 7 wherein said package is a single package of a transparent material, the pictorial presentation on said at least one side of said postcard being partially visible from the exterior of said package and the pictorial presentation on said at least one side of said utilitarian item being visible from the exterior of said package.

9. A consumer package to be purchased by a consumer as a single unit, said package comprising:

a first compartment having are movable postcard therein, said postcard having a pictorial presentation on at least one side thereof; and a second compartment containing at least one removable utilitarian item therein, said utilitarian item having a pictorial presentation on at least one side thereof, wherein said pictorial presentation on said postcard matches said pictorial presentation on said utilitarian item.

10. The package of claim 9 wherein said package is of a transparent material, the pictorial presentation on said at least one side of said postcard being partially visible from the exterior of said package and the pictorial presentation on said at least one side of said utilitarian item being visible from the exterior of said package.

11. A consumer package to be purchased by a consumer as a single unit, said package comprising:

(a) a first compartment;

(b) a plurality of second compartments;

(c) a removable postcard disposed within said first compartment, said postcard having a pictorial presentation on at least one side thereof; and (d) a plurality of removable utilitarian items, each of said items respectively disposed within one of said plurality of second compartments, said utilitarian items having a pictorial presentation on at least one side thereof, wherein said pictorial presentation on said postcard matches said pictorial presentation on at least one of said utilitarian items.

12. The package of claim 11 wherein said package is of a transparent material, the pictorial presentation on said at least one side of said postcard being partially visible from the exterior of said package and the pictorial presentation on said at least one side of at least one of said utilitarian items being visible from the exterior of said package.

13. The package of claim 11 wherein said utilitarian items are selected from the group consisting of a keychain, a magnet, an article of clothing, an article of jewelry, a writing instrument, a phone card, a cigarette lighter and a glass.

14. A method of forming a unitary consumer package, said method comprising the steps of:

(a) disposing a postcard in a first area of a housing, said postcard having a pictorial presentation on at least one side thereof; and (b) disposing at least one utilitarian item in a second area of said housing, said utilitarian item having a pictorial presentation on at least one side thereof substantially identical to said pictorial presentation on said postcard, thereby forming said unitary consumer package.

* * * * *